US007650946B2

(12) United States Patent
Gazewood

(10) Patent No.: US 7,650,946 B2
(45) Date of Patent: Jan. 26, 2010

(54) DISCONNECT APPARATUS AND METHOD

(75) Inventor: Michael J. Gazewood, Hye, TX (US)

(73) Assignee: Venturi Oil Tools, Inc., Hye, TX (US)

( * ) Notice: Subject to any disclaimer, the term of this patent is extended or adjusted under 35 U.S.C. 154(b) by 164 days.

(21) Appl. No.: 11/590,065

(22) Filed: Oct. 31, 2006

(65) Prior Publication Data

US 2008/0099210 A1 May 1, 2008

(51) Int. Cl.
*E21B 23/00* (2006.01)
*E21B 17/04* (2006.01)
*E21B 17/06* (2006.01)

(52) U.S. Cl. ..... 166/377; 166/242.6; 166/242.7

(58) Field of Classification Search ..... 166/242.6, 166/242.7, 377; 403/322.2, 322.1, 31, 368, 403/371

See application file for complete search history.

(56) References Cited

U.S. PATENT DOCUMENTS 4,452,472 A * 6/1984 Crase ..... 285/3
4,655,291 A * 4/1987 Cox ..... 166/385
4,726,610 A * 2/1988 George et al. ..... 285/39
5,526,888 A * 6/1996 Gazewood ..... 175/320
6,098,716 A * 8/2000 Hromas et al. ..... 166/377
6,167,970 B1 * 1/2001 Stout et al. ..... 166/377
6,338,504 B1 1/2002 Hilliard
6,349,767 B2 * 2/2002 Gissler ..... 166/242.6
6,408,946 B1 * 6/2002 Marshall et al. ..... 166/317
6,923,256 B2 8/2005 Parker

* cited by examiner

*Primary Examiner*—Jennifer H Gay
*Assistant Examiner*—Cathleen R Hutchins
(74) *Attorney, Agent, or Firm*—Jones Walker

(57) ABSTRACT

A disconnect apparatus and method for use in a well bore. The apparatus comprises a top sub having a collet, and wherein the top sub has an external seal surface. The apparatus further comprises a bottom sub having a bore, and wherein the external seal surface and the bore cooperate. The apparatus further includes a support piston disposed within the collet, wherein the support piston has a plurality of fins formed on an outer portion of the support piston, and shear device, operatively attached to the top sub and the support piston, for attaching and detaching the top sub from the support piston. In one preferred embodiment, the collet member comprises a plurality of fingers having a gap between each individual finger. Also, the plurality of fingers may have an external thread formed thereon that engage an internal thread formed on the bottom sub.

23 Claims, 6 Drawing Sheets

DISCONNECT APPARATUS AND METHOD

BACKGROUND OF THE INVENTION

This invention relates to an apparatus for disconnecting. More specifically, but without limitation, this invention relates to an apparatus and method for disconnecting a work string from an assembly in a well bore.

In the course of drilling and producing hydrocarbons from wells, an operator will perform various well operations. The purpose of the operation may vary, but includes drilling, completing, producing, working over, abandonment, etc. Due to many different reasons, a work string that is concentrically disposed within the well bore may need to be withdraw. As well understood by those of ordinary skill in the art, operators may elect to have a portion of the work string, such as a bottom hole assembly, remain in the well bore. In order to withdraw the work string, disconnect devices have been developed.

Prior art disconnect devices allow for the detachment so that the work string is pulled out of the well bore, but some portion, such as the bottom hole assembly, is left in the well. Prior art devices suffer from many problems including but not limited to complexity of design, unreliable disengagement, and expensive manufacturing cost. The present invention solves these problems, and many others, as will be further described.

SUMMARY OF INVENTION

A disconnect apparatus for use in a well bore is disclosed. The apparatus comprises a top sub having a collet member disposed thereon, and wherein the collet member extends to an engagement end, and wherein the top sub has an external seal surface. The apparatus further comprises a bottom sub having an internal bore, and wherein the external seal surface and the internal bore cooperate. The apparatus further includes a support piston disposed within the collet member, wherein the support piston contains a plurality of fins formed on an outer portion of the support piston, and shear means, operatively attached to the top sub and the support piston, for attaching and detaching the top sub from the support piston.

In one preferred embodiment, the collet member comprises a plurality of fingers having a gap between each individual finger and wherein each of the fins are configured to fit within each of the gaps of each of the fingers. Also, the plurality of fingers may have an external thread member formed thereon, and wherein the external thread member will engage an internal thread formed within the internal bore of the bottom sub. Additionally, the shear means may include an aperture in the collet member and a groove formed within the support piston. In the most preferred embodiment, the shear means further includes a set of shear pins that will shear at a predetermined force.

The apparatus may further comprise a ball member operatively associated with a ball seat formed within the support piston. In one embodiment, the top sub is attached to a coiled tubing within the well bore. In another embodiment, the top sub is attached to a drill string within the well bore.

A method of disconnecting from a bottom hole assembly within a well bore is also disclosed. The method comprises providing a disconnect apparatus within the well bore, the disconnect apparatus being attached to the bottom hole assembly, the disconnect apparatus comprising: a top sub having a collet disposed thereon, and wherein the collet member extends to an engagement end, and wherein the top sub has an external seal surface; a bottom sub having an internal bore, and wherein the external seal surface and the internal bore cooperate; a support piston disposed within the collet, the support piston having formed on an outer portion a plurality of fins; an aperture in the collet and a groove formed within the support piston, and a shear pin set through the aperture and disposed within the groove so that the shear pin attaches the top sub to the support piston.

The method further includes placing a ball within the internal portion of the support piston, applying a pressure into the internal portion of the support piston, and shearing the pin that attached the top sub to the support piston. The method further comprises pumping the support piston into the inner bore of bottom sub, freeing the collet from the support piston, contracting the collet so that the collet no longer engages the internal thread means. The method further comprises exerting an upward pull force on the top sub so that the top sub is disconnected from the bottom sub. In one preferred embodiment, the collet comprises a plurality of fingers and the step of contracting the collet includes collapsing each finger.

In the most preferred embodiment, the shear pin is designed to shear at a predetermined shear force, and wherein the step of applying a pressure comprises exerting a predetermined hydraulic pressure, and wherein the step of shearing the pin includes shearing the pin at the predetermined pressure.

An advantage of the present invention is that the design allows for the apparatus to have a significant tension strength. Another advantage is that the apparatus has a minimum of parts that require movement and cooperation in order to disengage. Yet another advantage is that the apparatus can be used with rotating strings, such as drill strings. Another advantage is that the apparatus can be used with non-rotating strings such as coiled tubing.

A feature of the present invention is that the collet can expand and contract. Another feature is that the collet has external thread means formed thereon. Yet another feature is that the collet comprises fingers, and wherein the fingers provide for a gap. Another feature is that the fins on the support piston are configured to fit into the gap. Still yet another feature is the ball and ball seat means allow for hydraulic activation of the disconnect mechanism.

DETAILED DESCRIPTION OF THE PREFERED EMBDOIMENTS

Figure 1A:
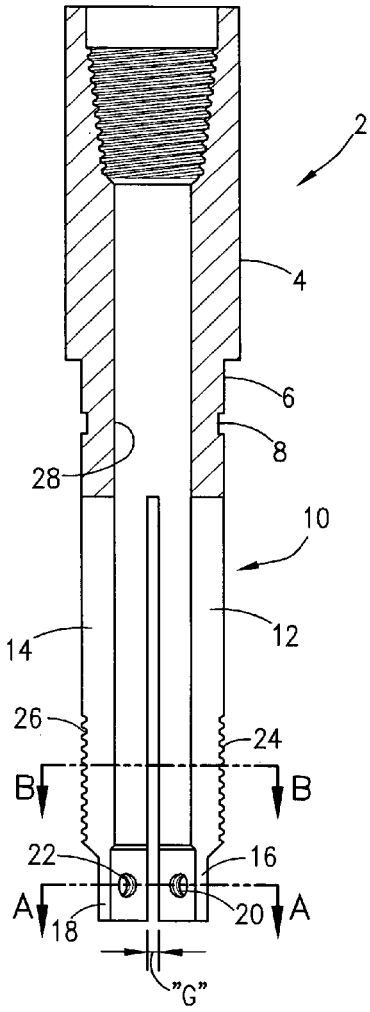
FIG. 1A is a cross-sectional view of the top sub of the preferred embodiment.

FIG. 1A is a cross-sectional view of the top sub 2 of the preferred embodiment. The top sub 2 has a first outer cylindrical surface 4 that extends to a second outer cylindrical surface 6, which in turn extends to the circumferential groove 8. The second outer cylindrical surface 6 extends to the collet member, seen generally at 10. The collet member 10 has a plurality of fingers. FIG. 1A depicts the fingers 12, 14. The fingers extend to an engagement end; more specifically, the finger 12 extends to the engagement end 16 and the finger 14 extends to the engagement end 18. The engagement end 16 contains an aperture 20 and the engagement end 18 contains an aperture 22, and wherein apertures 20, 22 will contain shear pins as will be more fully explained later in the application.

FIG. 1A also depicts the external thread means formed on the outer portion of the collet member 10; more specifically, FIG. 1A shows the external thread profile 24 on finger 12 and the external thread profile 26 on finger 14. FIG. 1A also depicts a gap that exist between each finger; for instance, the gap "G" between the finger 12 and finger 14. Extending radially inward, the inner bore 28 of the top sub 2 is also shown.

Figure 1B:
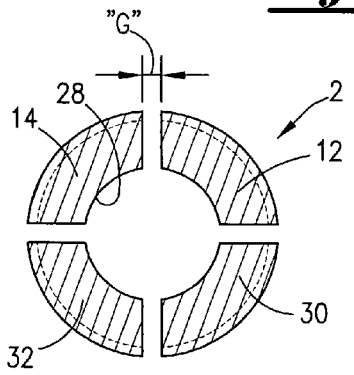
FIG. 1B is a cross-sectional view of the top sub taken from line B-B of FIG. 1A.
Figure 1C:
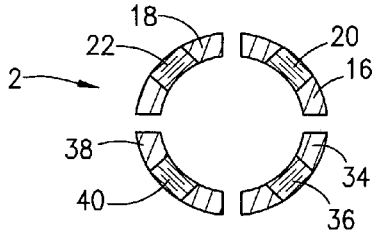
FIG. 1C is a cross-sectional view of the top sub taken from line A-A of FIG. 1A.

Referring now to FIG. 1B, a cross-sectional view of the top sub 2 taken from line B-B of FIG. 1A will now be described. This view depicts the fingers 12, 14 as well as the fingers 30, 32. The inner bore 28 is also depicted. FIG. 1C is a cross-sectional view of the top sub 2 taken from line A-A of FIG. 1A. FIG. 1C depicts the engagement end 16 and aperture 20, engagement end 18 and aperture 22, engagement end 34 and aperture 36, and engagement end 38 and aperture 40. Note that engagement end 34 extends from finger 30 and engagement end 38 extends from finger 32.

Figure 2:
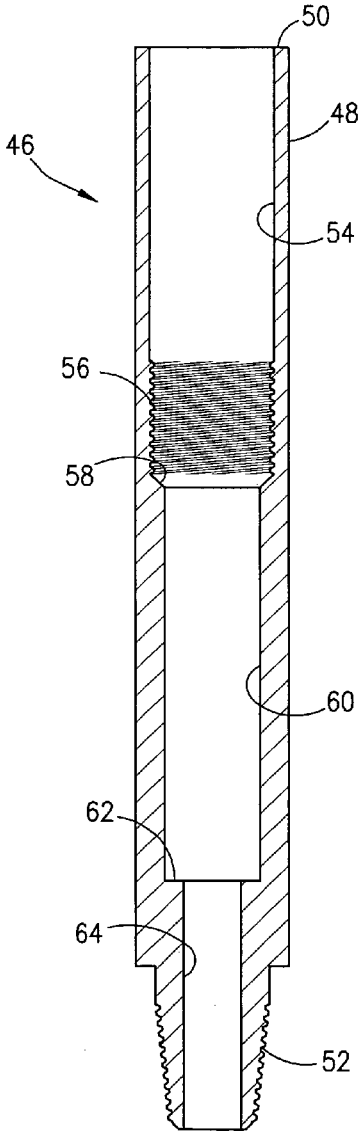
FIG. 2 is a cross-sectional view of the bottom sub of the preferred embodiment.

Referring now to FIG. 2, a cross-sectional view of the bottom sub 46 of the preferred embodiment will now be described. It should be noted that like numbers appearing in the various figures refer to like components. The bottom sub 46 contains an outer surface 48 that has a first radial end 50 and a second threaded end 52. Extending radially inward is the first inner bore 54 that extend to the internal thread means 56 which in turn terminates at the chamferred shoulder 58. Extending from the chamferred shoulder 58 is the second inner bore 60 that terminates at the radial shoulder 62. The third inner bore 64 extends from the radial shoulder 62.

Figure 3A:
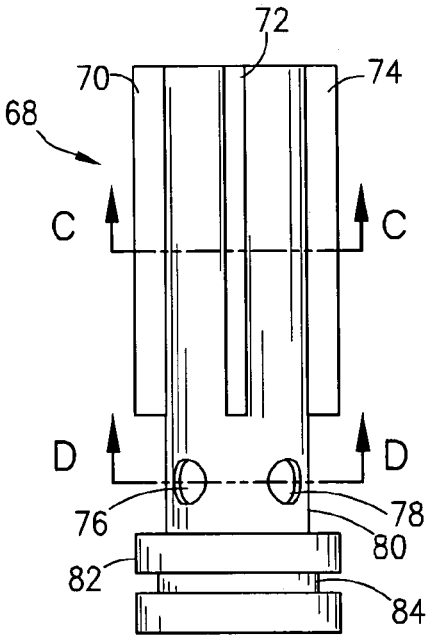
FIG. 3A is a side view of the support piston of the preferred embodiment.

FIG. 3A is a side view of the support piston 68 of the preferred embodiment. The support piston 68 is a generally cylindrical member that has a plurality of fins situated about the cylindrical member, such as fins 70, 72, 74. FIG. 3A also depicts the circular grooves 76, 78, and wherein the grooves 76, 78 will receive the shear pins as will be fully set out later in the application. The outer surface 80, which contains circular grooves 76, 78, extends to the outer surface 82, and wherein the outer surface 82 contains a circumferential groove 84, and wherein the groove 84 will contain a seal means such as an o-ring.

Figure 3C:
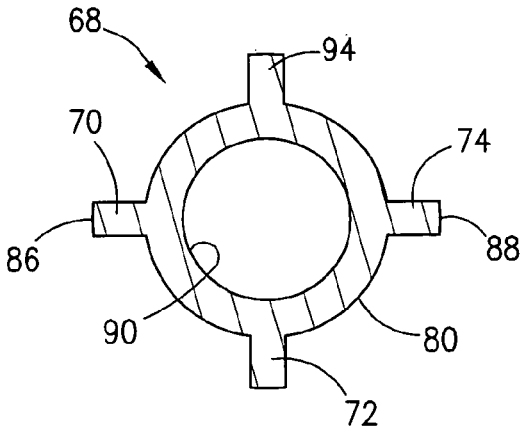
FIG. 3C is a cross-sectional view of the support piston taken from line C-C of FIG. 3A.
Figure 3B:
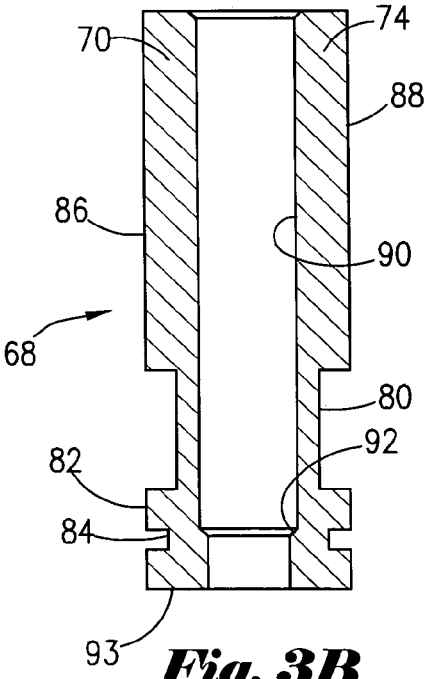
FIG. 3B is a cross-sectional view the support piston seen in FIG. 3A.
Figure 3D:
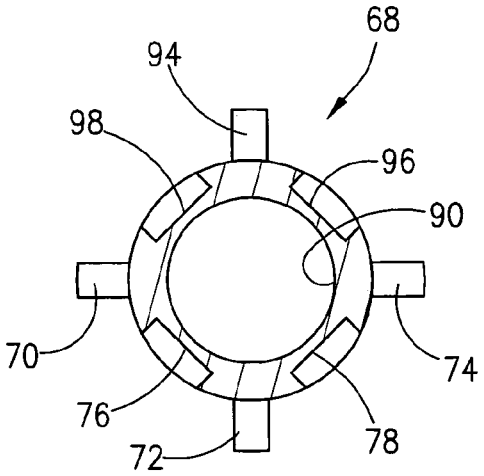
FIG. 3D is a cross-sectional view of the support piston taken from line D-D of FIG. 3A.

FIG. 3B depicts a cross-sectional view of the support piston 68 seen in FIG. 3A. The outer surface 86 of fin 70 and the outer surface 88 of fin 74 are shown. FIG. 3B illustrates the inner bore 90 that extends to the chamferred surface 92, and wherein the chamferred surface 92 is also referred to as the ball seat 92. FIG. 3B also depicts the radial end surface 93. Referring now to FIG. 3C, a cross-sectional view of the support piston 68 taken from line C-C of FIG. 3A. FIG. 3C depicts the fin 94 along with fins 70, 72, 74. The outer surface 80 and the inner bore 90 is also shown. In FIG. 3D, a cross-sectional view of the support piston 68 taken from line D-D of FIG. 3A depicts the circular grooves 76, 78 along with the circular grooves 96, 98 for receiving shear pins. The fins 70, 72, 74, 94 and the inner bore 90 are also shown.

Figure 4A:
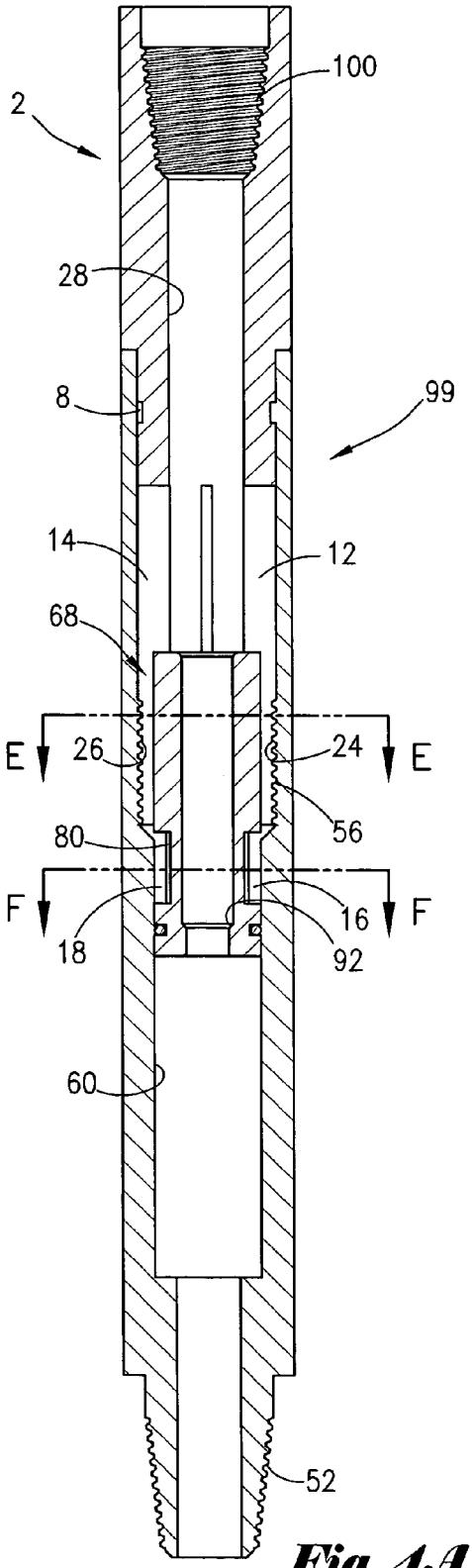
FIG. 4A is a cross-sectional view of the preferred embodiment of the assembled apparatus of the present invention.

Referring now to FIG. 4A, a cross-sectional view of the preferred embodiment of the assembled apparatus 99 of the present invention will now described. FIG. 4A depicts the top sub 2, with the support piston 68 being disposed within the second inner bore 60. Additionally, outer surface 80 will have an engagement end (i.e. 16, 18) disposed therein. In the position shown in FIG. 4A, the external thread means 24, 26 are engaged with the internal thread means 56. Hence, the threaded end 52 can be connected to a bottom hole assembly such as a drilling assembly (not shown in this view) and the thread means 100 can be threadly attached to a work string such as a drill string (not shown in this view), so that the drill string is connected to the bottom hole assembly. Note how the engagement ends (i.e. 16, 18) are attached to the support piston 68.

Figure 4B:
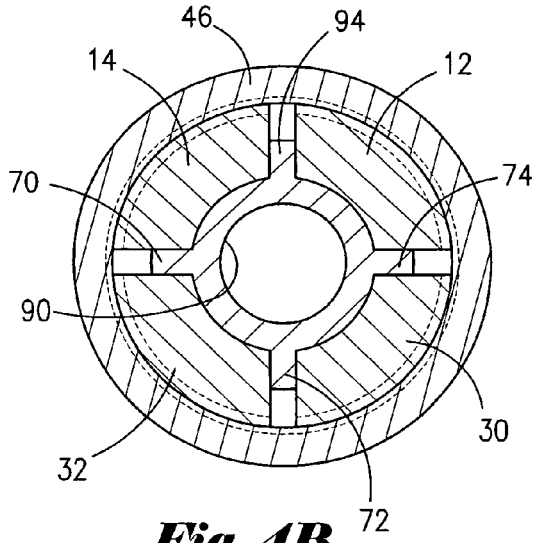
FIG. 4B is a cross-sectional view of the assembled apparatus taken from line E-E

Referring to FIG. 4B, which is a cross-sectional view of the assembled apparatus taken from line E-E, the fins 70, 72, 74, 94 are placed within the gaps between fingers 12, 14, 30, 32. The fins 70, 72, 74, 94 act to support and keep the fingers 12, 14, 30, 32 separated, which in turn keeps the threads on the outer portion of the fingers engaged with the internal threads of the bottom sub 46.

Figure 4C:
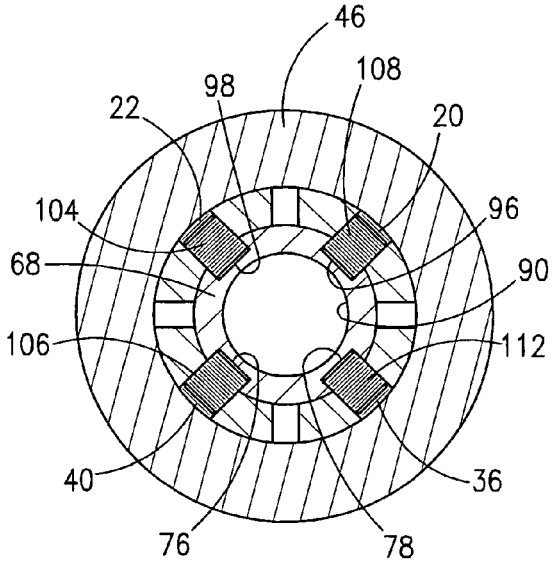
FIG. 4C is a cross-sectional view of the assembled apparatus taken from line F-F of FIG. 4A.

FIG. 4C, which is a cross-sectional view of the assembled apparatus taken from line F-F of FIG. 4A, depicts the shear pin 104 operatively associated with the aperture 22 and groove 98; the shear pin 106 operatively associated with the aperture 40 and groove 76; the shear pin 108 operatively associated with the aperture 20 and the groove 96; and the shear pin 112 operatively associated with the aperture 36 and the groove 78. The shear pins 104, 106, 108, 112 hold the support piston 68 in place relative to the bottom sub 46 and top sub 2. The shear pins will shear at a predetermined shear force, and wherein the shear force will be applied via a hydraulic force as will be more fully described.

Figure 5:
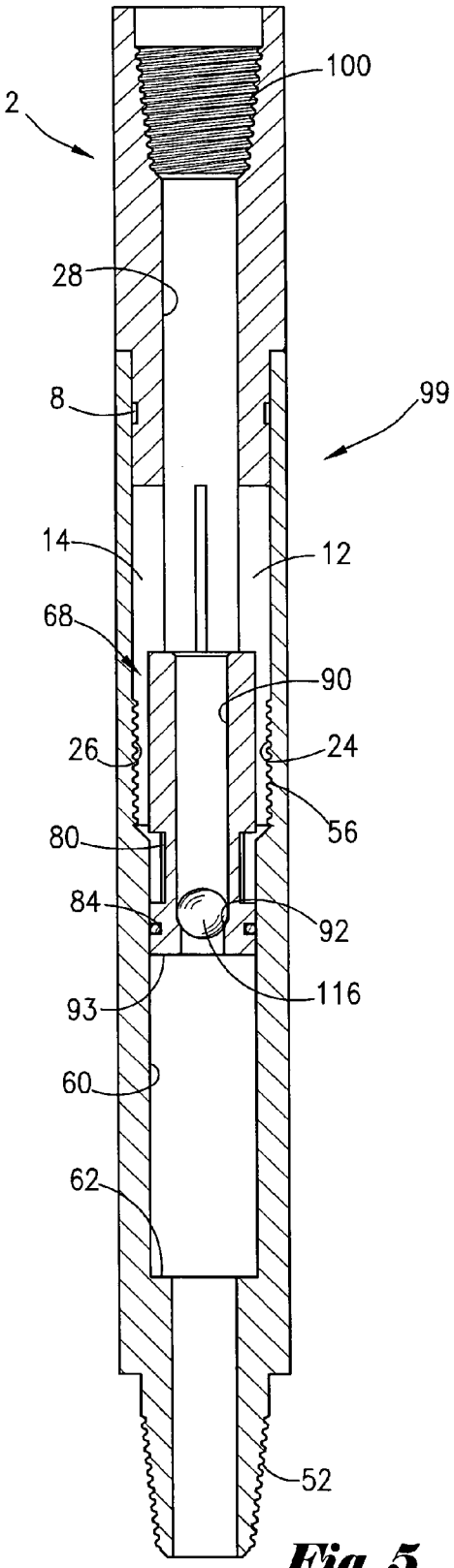
FIG. 5 is a cross-sectional view of the assembled apparatus seen in FIG. 4A with the ball seated in the ball seat.

Referring now to FIG. 5, a cross-sectional view of the assembled apparatus 99 seen in FIG. 4A with the ball 116 seated in the ball seat 92 will now be described. The ball 116 has been dropped through the work string and through the inner bore 90 of support piston 68. The operator will then begin increasing the hydraulic pressure within the work string so that the pressure within the apparatus begins to increase. The ball 116 cooperates with the ball seat 92. and creates a seal, and therefore, all pressure within the internal portion of the work string (which includes the apparatus) will be subjected to this pressure. The support piston 68 will be urged downward by the force acting on the ball 116. Once a predetermined amount of force is reached, the shear pins will shear, as those of ordinary skill in the art will recognize.

Figure 6:
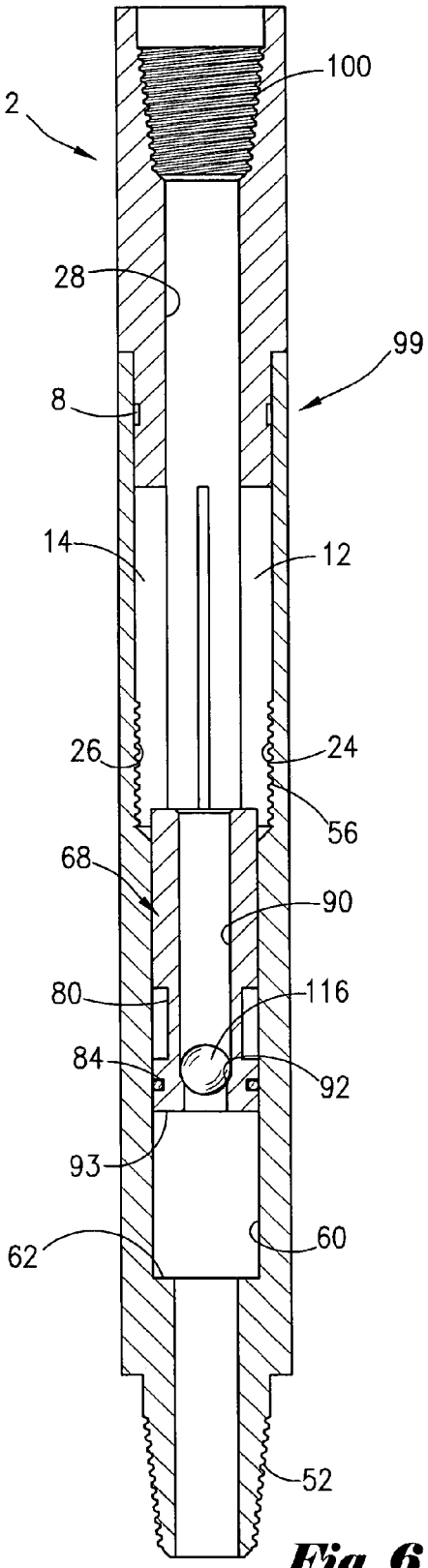
FIG. 6 is a sequential view of the assembled apparatus seen in FIG. 5 with the support piston in an intermediate position.

FIG. 6 is a sequential view of the assembled apparatus seen in FIG. 5 with the support piston 68 in an intermediate position. As noted earlier, the shear pins are set to shear at a predetermined force. Hence, once the pressure rises to a certain level, the shear pins sheared, and the support piston 68 will begin traveling in a direction away from the fingers 12, 14, as seen in FIG. 6. Note that in FIG. 6, the thread profiles 24, 26 are still engaged with the internal thread means 56.

Figure 7:
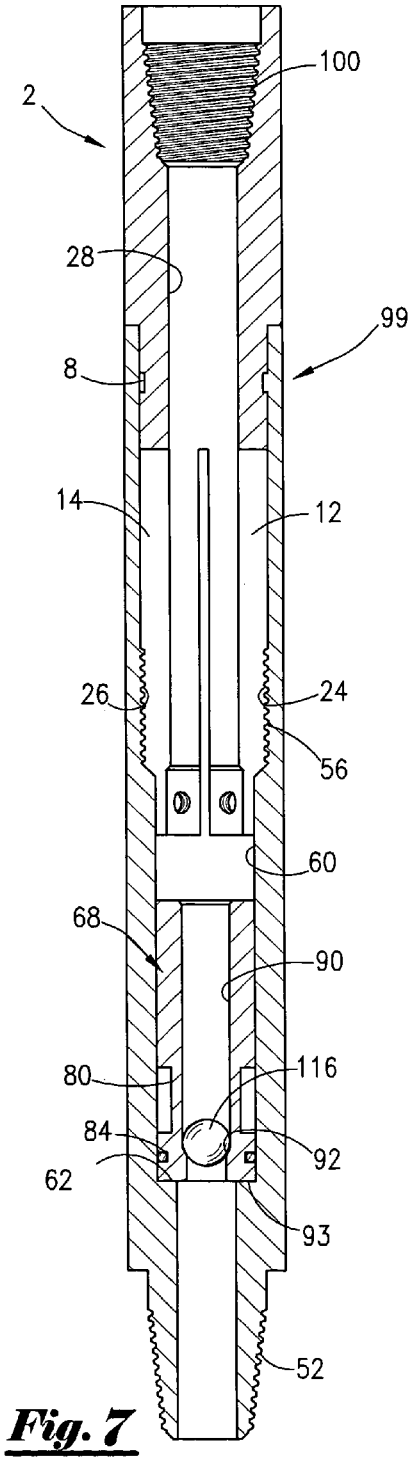
FIG. 7 is a sequential view of the apparatus seen in FIG. 6 with the support piston in fully released position.

FIG. 7 is a sequential view of the apparatus seen in FIG. 6 with the support piston 68 in the fully released position. As understood by those of ordinary skill in the art, the continued application of pressure causes the support piston 68 travel to the position seen in FIG. 7, wherein the radial end surface 93 abuts radial shoulder 62. Additionally, the continued application of pressure will cause the fingers of the collet member (fingers 12, 14 are shown) to begin to contract since the pressure will act in between the external threads (i.e. threads 24, 26) and internal threads 56. This contraction of the fingers will disengage the external threads on the fingers (i.e. threads 24, 26) from the internal threads 56.

Figure 8A:
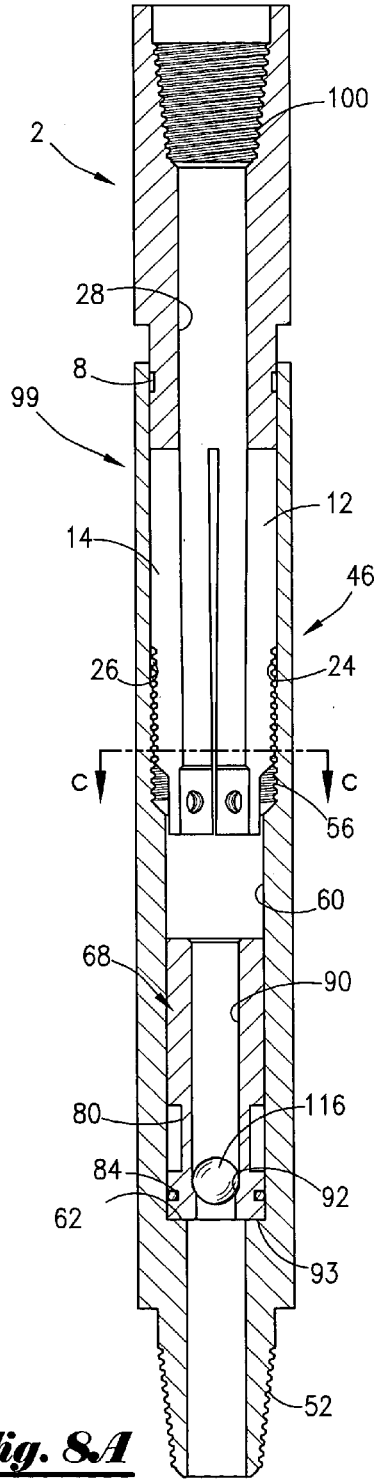
FIG. 8A is a sequential view of the apparatus seen in FIG. 7 with the collet thread means being disengaged.
Figure 8B:
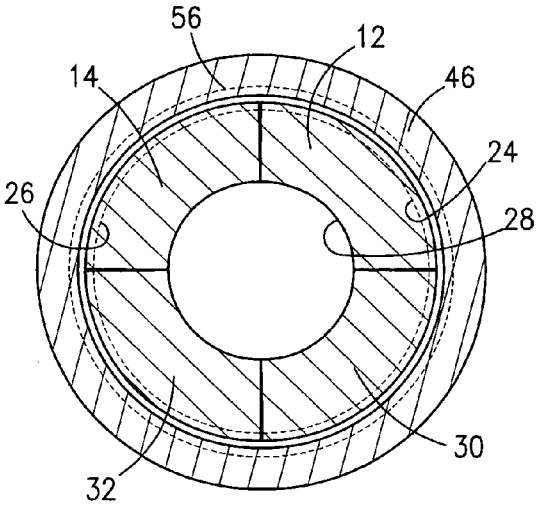
FIG. 8B is a cross-sectional view of the apparatus taken from line C-C of FIG. 8A.

Referring now to FIG. 8A, a sequential view of the apparatus seen in FIG. 7 with the collet thread means (i.e. threads 24, 26) being disengaged from internal threads 56 is shown. Also, the top sub 2 is being lifted and separated from the bottom sub 46. The support piston 68 will stay positioned within the bottom sub 46. In FIG. 8B, which is a cross-sectional view of the apparatus taken from line C-C of FIG. 8A, the external threads of the collet (i.e. 24, 26) have separated from the internal threads 56, and the collet fingers 12, 14, 30, 32 have contracted thereby allowing for the removal of the top sub 2.

Figure 9:
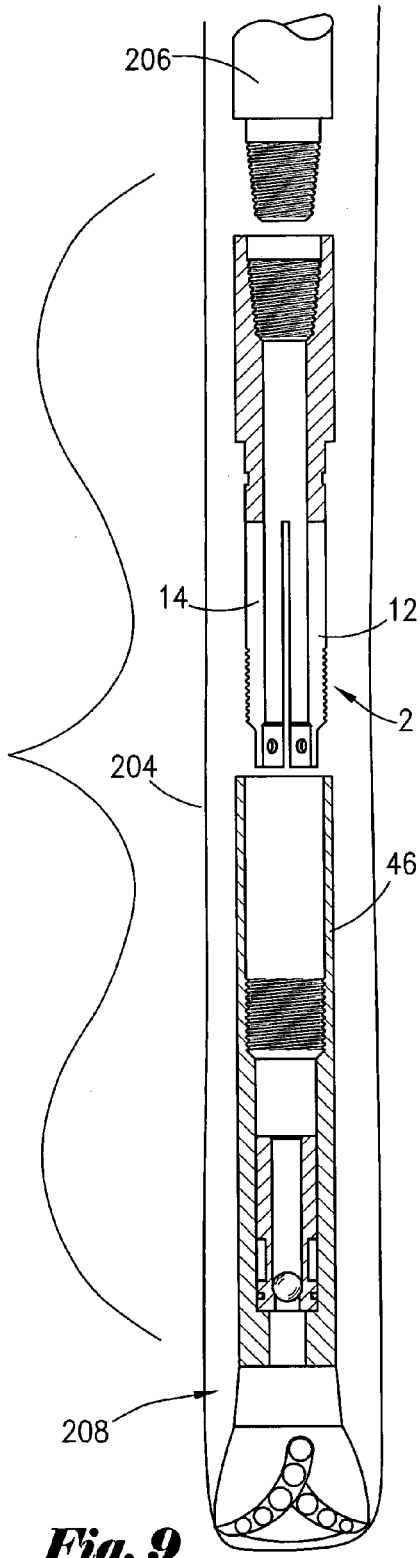
FIG. 9 is a sequential view of the apparatus seen in FIG. 8A with the top sub being removed from the well bore.

FIG. 9 is a sequential view of the apparatus seen in FIG. 8A with the top sub 2 being removed from the well bore 204 via a work string 206, and wherein in one embodiment the work string may be a coiled tubing string and in another embodiment the work string is a drill string. FIG. 9 further depicts that the bottom sub 46 is connected to a bottom hole assembly 208, and wherein the bottom hole assembly 108 contains a drill bit means for boring the well bore, as well understood by those of ordinary skill in the art.

While the particular invention as herein shown and disclosed in detail is fully capable of obtaining the features and providing the advantages hereinbefore stated, it is to be understood that this disclosure is merely illustrative of the presently preferred embodiments of the invention and that no limitations are intended other than as described in the appended claims.

I claim:

1. A disconnect apparatus for use in a well bore comprising:

a top sub having a portion thereof comprising a collet member, said collet member extending to an engagement end, said top sub having an external seal surface;

a bottom sub having an internal bore, said external seal surface and said internal bore cooperating;

a support piston disposed within the collet member, said support piston having formed on an outer portion a plurality of fins, each of said fins projecting radially outward from said outer portion;

shear means, operatively attached to said lop sub and said support piston, for attaching and detaching said top sub from said support piston;

wherein said collet member comprises a plurality of fingers having a gap between each of said fingers and wherein each of said fins of said piston is configured to fit within one of said gaps of said collet member.

2. The apparatus of claim 1 wherein said plurality of fingers of said collet member have an external thread member formed thereon, and wherein said external thread member engages an internal thread formed within said internal bore of said bottom sub.

3. The apparatus of claim 2 wherein said shear means includes an aperture in said collet member and a groove formed within said support piston.

4. The apparatus of claim 3 further comprising:

a ball member operatively associated with a ball seat formed within said support piston.

5. The apparatus of claim 4 wherein said top sub is attached to a coiled tubing within the well bore.

6. The apparatus of claim 4 wherein said top sub is attached to a drill string within the well bore.

7. The apparatus of claim 4 wherein said shear means further includes a set of shear pins that will shear at a predetermined force.

8. A disconnect apparatus for use in a well bore comprising:

a top sub having a portion comprising a collet member, said collet member extending to an engagement end, said top sub having an external seal surface;

a bottom sub having an internal bore, said external seal surface and said internal bore cooperating to form a sealing surface;

a support piston disposed within the collet member, said support piston having formed on an outer portion a plurality of fins, each of said fins projecting radially outward from said outer portion;

shear means, operatively attached to said top sub and said support piston, for attaching and detaching said top sub from said support piston;

a ball member operatively associated with a ball seat formed within said support piston;

wherein said collet member comprises a plurality of fingers having a gap between each of said fingers and wherein each of said fins of said piston is configured to fit within one of said gaps of said collet member.

9. The apparatus of claim 8 wherein said shear means includes an aperture in said collet member and a groove formed within said support piston, and a set of shear pins set through the aperture and disposed within said groove.

10. The apparatus of claim 9 wherein said plurality of fingers of said collet member have an external thread member formed thereon, and wherein said external thread member engages an internal thread formed within said internal bore of said bottom sub.

11. The apparatus of claim 10 wherein said top sub is attached to a coiled tubing within the well bore.

12. The apparatus of claim 10 wherein said top sub is attached to a drill string within the well bore.

13. The apparatus of claim 9 wherein said set of shear pins will shear at a predetermined hydraulic force.

14. A method of disconnecting from a bottom hole assembly within a well bore, the method comprising:

providing a disconnect apparatus within the well bore, the disconnect apparatus being attached to the bottom hole assembly, the disconnect apparatus comprising: a top sub having a portion comprising a collet member, said collet member extending to an engagement end, said top sub having an external seal surface; a bottom sub having an internal bore, said external seal surface and said internal bore cooperating; a support piston disposed within the collet member, said support piston having formed on an outer portion a plurality of fins, each of said fins projecting radially outward from said outer portion; an aperture in said collet member and a groove formed within said support piston, and a shear pin set through the aperture and disposed within said groove, wherein said collet member comprises a plurality of fingers having a gap between each of said fingers and wherein each of said fins of said piston is configured to fit within one of said gaps of said collet member, and wherein the shear pin attaches said top sub to support piston;

placing a ball within the internal portion of the support piston;

applying a pressure into the internal portion of the support piston;

shearing the pin that attached the top sub to the support piston;

pumping the support piston into the inner bore of bottom sub;

freeing said collet member from the support piston;

contracting the collet member so that the collet member no longer engages the internal thread means;

exerting an upward pull force on the top sub so that the top sub is disconnected from the bottom sub.

15. The method of claim 14 wherein the step of contracting said collet member includes:

collapsing said plurality of fingers of said collet member so that an external thread on said plurality of fingers is no longer engaged with an internal thread located on said top sub.

16. The method of claim 15 wherein said shear pin is designed to shear at a predetermined shear force, and wherein the step of applying a pressure comprises exerting a predetermined hydraulic pressure, and wherein the step of shearing the pin includes shearing the pin at the predetermined pressure.

17. A disconnect apparatus for use in a well bore comprising:

a top sub having a portion comprising a collet member, said collet member having a plurality of fingers having a gap between each individual finger, said plurality of fingers extending to an engagement end that has an aperture, said top sub having an external seal surface;

a bottom sub having an internal bore, said external seal surface and said internal bore cooperating, said plurality of fingers having an external thread member formed thereon, said external thread member engaging an internal thread formed within said internal bore of said bottom sub;

a support piston disposed within the collet member, said support piston having formed on an outer portion a plurality of fins, each of said fins projecting radially outward from said outer portion and configured to fit into one of said gaps, said support piston having a groove formed thereon;

a ball member operatively associated with a ball seat formed within said support piston;

a shear pin set through the aperture and disposed within said groove.

18. The apparatus of claim 17 wherein said shear pin will shear at a predetermined hydraulic force.

19. A disconnect apparatus for use in a well bore comprising:

a top sub having a portion comprising a collet member, said collet member extending to an engagement end, said top sub having an external seal surface;

a bottom sub having an internal bore, said external seal surface and said internal bore cooperating;

a support piston disposed within the collet member, said support piston having formed on an outer portion a plurality of fins, each of said fins projecting radially outward from said outer portion;

wherein said collet member comprises a plurality of fingers having a gap between each of said fingers and wherein each of said fins of said piston is configured to fit within one of said gaps of said collet member.

20. The apparatus of claim 19 wherein said plurality of fingers have an external thread member formed thereon, and wherein said external thread member engages an internal thread formed within said internal bore of said bottom sub.

21. The apparatus of claim 20 further comprising a ball member operatively associated with a ball seat formed within said support piston.

22. The apparatus of claim 21 wherein said top sub is attached to a coiled tubing within the well bore.

23. The apparatus of claim 21 wherein said top sub is attached to a drill string within the well bore.

* * * * *